US010886706B2

(12) United States Patent
Zhou

(10) Patent No.: US 10,886,706 B2
(45) Date of Patent: Jan. 5, 2021

(54) FLAME-EJECTING SPARK PLUG, AND INTERNAL COMBUSTION ENGINE AND AUTOMOBILE HAVING SAME

(71) Applicant: Zhou (Beijing) Automotive Technology Co., Ltd., Beijing (CN)

(72) Inventor: Xiangjin Zhou, Beijing (CN)

(73) Assignee: Zhou (Beijing) Automotive Technology Co., Ltd., Beijing (CN)

( * ) Notice: Subject to any disclaimer, the term of this patent is extended or adjusted under 35 U.S.C. 154(b) by 0 days.

(21) Appl. No.: 16/609,193

(22) PCT Filed: Jul. 13, 2017

(86) PCT No.: PCT/CN2017/092852
§ 371 (c)(1),
(2) Date: Jan. 8, 2020

(87) PCT Pub. No.: WO2018/196175
PCT Pub. Date: Nov. 1, 2018

(65) Prior Publication Data

US 2020/0220336 A1 Jul. 9, 2020

(30) Foreign Application Priority Data

Apr. 26, 2017 (CN) ..... 2017 1 0281440

(51) Int. Cl.
*H01T 13/06* (2006.01)
*H01T 13/20* (2006.01)
(Continued)

(52) U.S. Cl.
CPC ..... *H01T 13/20* (2013.01); *H01T 13/02* (2013.01); *H01T 13/54* (2013.01)

(58) Field of Classification Search
CPC ..... H01T 13/06
(Continued)

(56) References Cited

U.S. PATENT DOCUMENTS 6,013,973 A * 1/2000 Sato ..... H01T 13/54 313/140
2004/0065286 A1* 4/2004 Raff ..... H01T 13/44 123/169 PA (Continued)

FOREIGN PATENT DOCUMENTS

CN 103050890 A 4/2013
CN 203039231 U 7/2013

(Continued)

*Primary Examiner* — Christopher M Raabe
(74) *Attorney, Agent, or Firm* — Helen S Liu; Liu Law Office

(57) ABSTRACT

Disclosed are a flame-ejecting spark plug, and an internal combustion engine and an automobile having same. On the basis of a conventional spark plug, a space near to an electrode is closed to form a cavity (10), an end face is provided with at least one first hole (11), and a side face is provided with at least one second hole (13). A mixture of air and fuel enters the cavity (10) through the first hole (11) and the second hole (13). Electric discharge between the electrodes produces a spark igniting the combustible gas within the cavity (10), and the flame extends in the cavity (10) and the temperature and pressure rise. The flame is ejected from the first hole (11) and the second hole (13) to form a plurality of columnar flames, and the flame penetrates the combustible gas in a combustion chamber and a cylinder to realize stereoscopic ignition, large-area ignition and high-energy ignition of the combustible gas in the combustion chamber.

17 Claims, 4 Drawing Sheets

(51) Int. Cl.
*H01T 13/02* (2006.01)
*H01T 13/54* (2006.01)

(58) Field of Classification Search
USPC ..... 313/141
See application file for complete search history.

(56) References Cited

U.S. PATENT DOCUMENTS

| | | | | |
|---|---|---|---|---|
| 2005/0211217 | A1 | 9/2005 | Boley et al. | |
| 2007/0069617 | A1* | 3/2007 | Tozzi | F02B 19/12 313/140 |
| 2012/0299459 | A1* | 11/2012 | Sakakura | H01T 13/467 313/141 |
| 2013/0206101 | A1* | 8/2013 | Douglas | F02B 19/12 123/260 |
| 2015/0059456 | A1* | 3/2015 | Niessner | H01T 13/54 73/114.19 |
| 2016/0053670 | A1* | 2/2016 | Tozzi | F02B 19/18 123/260 |
| 2016/0276810 | A1* | 9/2016 | Chiera | F02B 19/12 |
| 2018/0128157 | A1* | 5/2018 | VanDerWege | F02B 19/12 |

FOREIGN PATENT DOCUMENTS

| | | | |
|---|---|---|---|
| CN | 104767123 | A | 7/2015 |
| CN | 204597221 | U | 8/2015 |
| CN | 105119144 | A | 12/2015 |
| CN | 204992247 | U | 1/2016 |

* cited by examiner

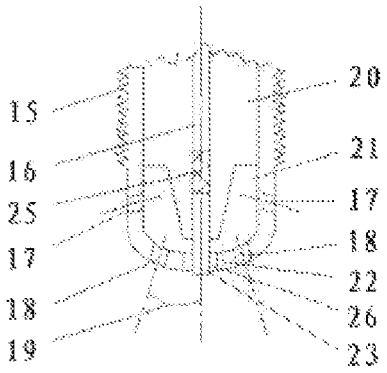
Figure 4A
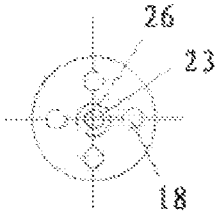
Figure 4B
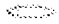
Figure 5A
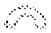
Figure 5B
Figure 5C
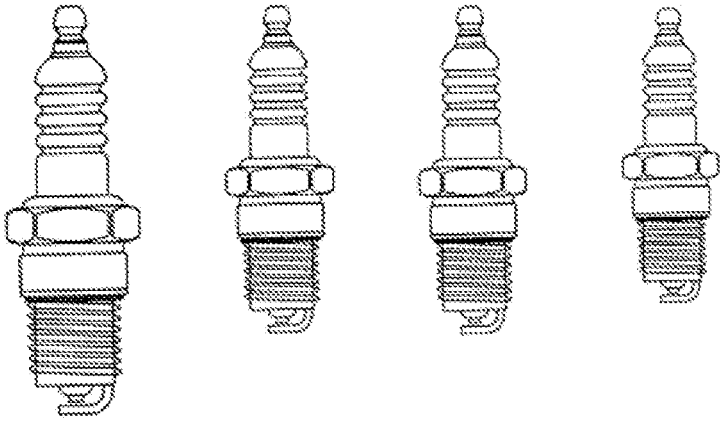
Figure 6 (Existing Prior Art)

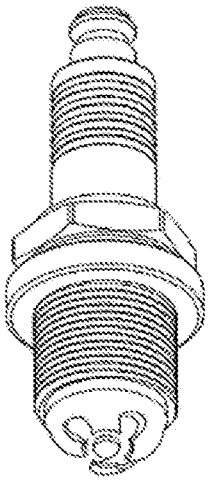
Figure 7 (Existing Prior Art)
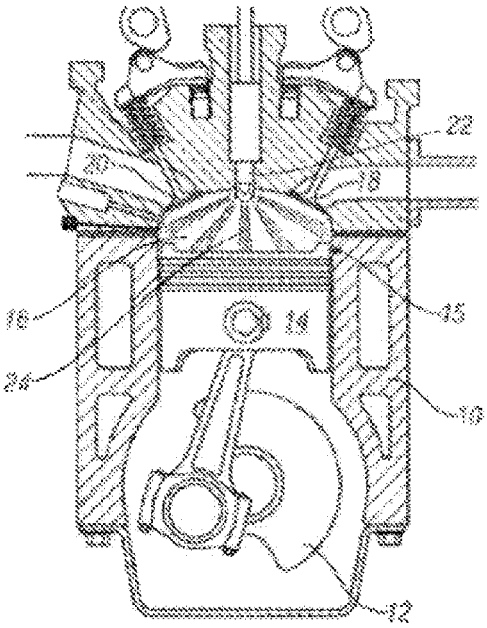
Figure 8

FLAME-EJECTING SPARK PLUG, AND INTERNAL COMBUSTION ENGINE AND AUTOMOBILE HAVING SAME

CROSS REFERENCE TO RELATED APPLICATIONS

This application claims the priority of International Application No. PCT/CN2017/092852 filed on Jul. 13, 2017, which claims priority of Chinese patent application CN201710281440.2, entitled "Flame-ejecting Spark Plug, And Internal Combustion Engine and Automobile Having Same", filed on Apr. 26, 2017. The whole content of PCT/CN2017/092852 and Chinese patent application No. 201710281440.2are incorporated herein by reference.

FIELD

The invention belongs to the technical field of automobile and internal combustion engine in the mechanical and electronic industry.

BACKGROUND

Internal combustion engine is generally composed of cylinder, piston, connecting rod, crankshaft, valve, fuel pump, nozzle as main components and other accessories. Some internal combustion engines can omit the valve and use the different positions of the piston in the cylinder to switch the intake channel and exhaust channel.

The existing ignition device of internal combustion engine is mainly spark plug, which ignites the mixture gas of fuel and air through electric spark, and the ignition source is point shape. The magnitude of ignition intensity affects the combustion rate of combustible gas.

The spark plug structure of the plasma ignition device is a middle electrode, and there are four electrodes around the middle electrode. It is said that the spark plug of this kind of ignition device can produce 100 times of the energy of ordinary spark plug.

In order to increase the ignition reliability of aviation piston gasoline engine, two spark plugs are set in each cylinder, which are respectively controlled by two power supply circuits.

The internal combustion engine with spark plug ignition is not limited to gasoline engine, but also the internal combustion engine with natural gas and liquefied petroleum gas as fuel.

A spark ignition ignition internal combustion engine compared with a compression ignition internal combustion engine, the combustion speed of combustible gas in combustion chamber is slower, because the ignition source is a point shape spark ignition source. Compression ignition internal combustion engine is multi-point ignition. Under the condition of high temperature and high pressure, there are many self-ignition places in the combustible gas, and there are many ignition sources at the same time. Therefore, the compression ratio and the air-fuel ratio of the compression ignition engine can be higher, and the thermal power conversion efficiency is generally about 30% higher than that of the spark ignition engine.

In order to improve the efficiency, some gasoline engines or natural gas engines adopt the compression ignition method, using diesel oil as the second fuel, injecting a small amount of diesel oil into the combustion chamber and cylinder in the compression stroke. Using the characteristics of low self-ignition point of diesel oil, the diesel oil injected into the combustion chamber is atomized and self-ignited, forming a multi-point ignition source, igniting the combustible gas of mixture of gasoline or natural gas and air in the combustion chamber and cylinder, so as to realize the multi-point ignition of gasoline or natural gas engine, improve the combustion speed, improve the compression ratio of cylinder, and improve the conversion efficiency of engine thermal power. For reference of patent application, please refer to a diesel compression ignition gasoline engine (CN2365405Y, publication date: Feb. 23, 2000). The disadvantage of this engine is that the fuel supply system is complex and the cost increases.

SUMMARY

1. Contents of the Invention:

1) A multi-point ignition method adopts a spark plug capable of spraying flame, uses the fuel of internal combustion engine as the main ignition energy source, uses the electric spark as the initial fire source, and sprays one or more flames to the combustible gas (fuel-air mixture area) in the combustion chamber and cylinder of internal combustion engine, so that the flame penetrates the fuel-air mixture area. The ignition area, ignition range and ignition intensity are far greater than the traditional spark plug can achieve the ignition effect, which is equivalent to the effect of multi-point ignition of diffusion compression ignition internal combustion engine. The combustion time of fuel-air mixture is shortened, so the thermal efficiency of the internal combustion engine is improved, and the possibility of detonation is avoided and reduced at the same time.

2) This kind of spark plug can be called a flame-ejection spark plug. The applicable internal combustion engine includes gasoline engine with gasoline as fuel, engine with natural gas or liquefied petroleum gas as fuel, and other engines with spark plug as ignition device. Gasoline grade (octane number, research method) can be reduced to 89 and less than 89. Fuel sources include but are not limited to oil, natural gas, shale gas, biogas, coal and biomass.

3) A kind of flame-ejecting spark plug, in which, on the basis of traditional spark plug, a space near the electrode is closed to form a cavity, one or more first holes are opened at the end face of the cavity, one or more second holes are opened at the side face, air and fuel gas enter the cavity through the first hole and the second hole, and electric spark is generated between the electrodes to ignite the combustible gas in the cavity, with the extension of the flame in the cavity and the rise of temperature and pressure, the flame is ejected from the small hole to form a columnar flame. The flame enters the combustible gas in the combustion chamber and cylinder to realize the three-dimensional ignition, large-area ignition and high-energy ignition. Among them, the ignition effect of columnar flame penetrating combustible gas is better.

Generally, when the ratio of air and fuel of a gasoline engine is 14.7:1, the speed of fire extension is about 75 m/s after the mixture of gasoline and air is ignited. In order to achieve the expected technical effect, the flame ejecting speed of the flame-ejecting spark plug must be much higher than 75 m/s, reach the bottom of the combustion chamber in advance, and ignite the fuel-air mixture gas near the bottom, instead of the fire spreading and extending from the spark plug to the bottom, after the fuel-air mixture close to the spark plug is ignited. The faster the flame speed is, the farther the flame spray distance is, the more the number of columnar flame is, the more evenly dispersed each column flame, the better. When the combustion pressure in the spark plug cavity is high enough, the speed of the flame from the first hole and the second hole can reach more than 150 m/s. The optimal speed is 225-375 m/s. The flame spray distance is required to exceed the distance from the top of the combustion chamber to the top of the piston when the piston is in the middle of the bottom dead center and the top dead center. The factors that affect the combustion pressure in the cavity of the spark plug, the flame injection velocity, and the flame injection distance mainly include the volume of the cavity, the total area of the injection hole, the ignition position inside the cavity, and concentration of the fuel and air.

In order to ensure that the spark plug can have a high injection speed and a long injection distance, the choice of where the spark is generated inside the spark plug is very important. The distance from the middle position between the cathode and anode of the electrode (the middle position of the line section generating the electric spark) to the edge of the nearest hole is 0.1-0.9% of the value of the cavity volume, the preferred value is 0.2-0.5%, the typical value is 0.3%, and the unit is mm. For example, the cavity volume is 1000 cubic mm (mm3), and the typical value of the distance from the middle position between the cathode and anode of the electrode to the edge of the nearest hole is 1000×0.3%=3 (mm). At the same time, the intermediate position between the cathode and anode of the electrode (the intermediate position of the line section generating the electric spark) is satisfied that the volume of the internal cavity of the spark plug is divided into two parts along the cross section of the central axis of the spark plug, wherein the volume near the first hole accounts for between one-fifth and one-half of the total volume, and the volume between one-quarter and one-third is better.

If the intermediate position between the cathode and anode of the electrode is too close to the first hole of the spark plug, the combustion inside the spark plug is insufficient, and the flame has ejected from the spark plug cavity when high pressure is not formed, and the ignition of the combustible mixture of fuel and air in the combustion chamber is too early; if the intermediate position between the cathode and anode of the electrode is too far from the first hole, after the arc ignites the fuel-air mixture inside the spark plug, with the increase of the pressure, part of the unburned fuel gas is squeezed out of the injection hole, and the ignition energy is reduced. When the flame starts to spray, the fuel inside the spark plug has been burned out, and the aftereffect of the injected flame is insufficient. Although the injection speed is fast enough, the injection distance is not far. The ideal technical scheme requires that the columnar flame of the first hole has a fast spraying speed and a long spraying distance.

In order to ensure that the spark plug has a high enough jet pressure, and the jet flame has a sufficient jet speed and distance, on the premise that the total area of the jet holes is determined, the priority is to ensure the diameter of a single jet hole, and then consider as many jet holes as possible.

The method of increasing the distance from the middle position between the cathode and anode of the electrode to the edge of the nearest first hole includes: 1) increasing the height of a protruding structure on the inside face of the 14 cathode electrode in FIG. 1 and shortening the length of the 12 center electrode (anode); 2) increasing the distance between the nearest first holes and the central axis of the spark plug in FIG. 2B or FIG. 2C.

As a temporary technical measure, the application can increase the coverage area of the space near the positive electrode and its insulator on the basis of the existing semi open type spark plug (as shown in FIG. 7), and obtain a flame spraying type spark plug with the irregular shape of the end face spray hole and the side spray hole.

4) A flame-ejecting spark plug, wherein the first hole on the end face and the second hole on the side face of the cavity have a spraying angle in the radial direction, or at the same time have an inclination angle in the circumferential direction.

5) A flame-ejecting spark plug, wherein the position of the center electrode is a built-in structure, or a semi-exposed structure, or a bare structure;

The shape of the spray hole is one of a circle, a circular ring shape, a leaf shape, a semicircular ring shape, a rectangle, a triangle, and a three-leaf shape connected by three rectangles, or a combination of the above shapes.

6) An internal combustion engine using the flame-ejecting spark plug, in which fuel and air are used as the main sources of ignition energy; because the combustion speed of internal combustion engine is faster than that of traditional internal combustion engine, the time of spark plug ignition needs to be postponed to the position where the piston is close to the top dead center, while the time of arc ignition needs to be determined according to the distance between the middle position of positive and negative electrodes and the edge of the nearest first hole. Therefore, the negative work of compression stroke caused by combustion is smaller, and the thermal power conversion efficiency of the engine is higher.

7) An internal combustion engine has the following technical features: at the same time, two or more flame-ejecting spark plugs are used as the ignition device; or the combination of one flame-ejecting spark plug and one traditional spark plug is used as the ignition device.

8) An internal combustion engine has the following technical features: adopting stratified combustion technology and control scheme; or adopting lean combustion technology and control scheme; or adopting stratified combustion and lean combustion technology and control scheme at the same time.

9) The internal combustion engine has the following technical features: the compression ratio of the cylinder is 10:1 to 21:1; or it has a turbocharging device at the same time; or it has a turbocharging device and a mechanical supercharging device at the same time.

10) A turbine engine (including but not limited to turbo shaft engine, turbofan engine and gas turbine), in which a flame-ejecting spark plug is used as the ignition device.

11) An internal combustion engine vehicle or hybrid electric vehicle (including but not limited to motorcycles, construction machinery, agricultural machinery, etc.), wherein the above-mentioned flame-ejecting spark plug is used as the ignition device, or the above-mentioned internal combustion engine is used as the power device.

12) An aircraft (including but not limited to an aircraft, helicopter, airship, power parachute, power wing), in which a flame-ejecting spark plug is used as an ignition device, or the above-mentioned internal combustion engine is used as a power device, or the above-mentioned turbine engine is used as a power device.

13) A ship or underwater vehicle (including but not limited to a submarine) in which the above-mentioned spark plug is used as the ignition device, or the above-mentioned internal combustion engine is used as the power device, or the above-mentioned gas turbine or turbine engine is used as the power device.

14) The invention relates to an ignition method of an industrial furnace or kiln, in which the flame-ejecting spark plug is used as an ignition device. This kind of spark plug, also known as ignition rod, is generally much longer than the spark plug of internal combustion engine.

15) The above-mentioned internal combustion engine can effectively reduce the content of nitrogen and oxygen compounds in the exhaust gas by adopting the technology of partial exhaust gas recycling.

16) As the forced ignition device of HCCI gasoline engine, the above-mentioned flame-ejecting spark plug uses the energy provided by the columnar flame to trigger HCCI, instead of relying on the chemical reaction between fuel and high-temperature air (including the exhaust gas for reuse) to release heat (known as pre-combustion) as the heating energy source of direct compression ignition.

3. Deficiencies of the Prior Art:

1) The ignition source of a traditional spark plug of a gasoline engine is a point shape, with small ignition area.

2) The ignition core of a plasma spark plug is larger than that of an arc discharge spark plug, but the ignition energy cannot play a full role and the ignition efficiency is low.

3) The combustion speed in the combustion chamber of the existing gasoline engine is relatively slow. The combustion in the fuel-air mixing area starts from the spark plug and is realized by the extension of the flame surface generated from the periphery of the fire core. Not only combustion speed is slow, but also easy to produce knocking.

4) The conversion efficiency of thermal power of gasoline engine ignited by spark plug is relatively low.

4. Technical Problems to be Solved:

1) Increase the number of ignition sources of the internal combustion engine to realize multi ignition.

2) Increase ignition area, intensity and efficiency.

3) Increase the combustion speed of the fuel-air mixture in the combustion chamber.

4) Improve the thermal efficiency of internal combustion engine.

5) Reduce knock.

5. Technical Measures of the Invention:

1) A flame-ejecting spark plug, as shown in FIG. 1. On the basis of a traditional spark plug, a space near the electrode is closed to form a cavity. One or more first holes are opened on the end face of the cavity, and one or more second holes are opened on the side face of the cavity. The air and fuel mixture in the combustion chamber enter the cavity through the first hole and the second hole during the compression stroke. The discharge between the electrodes produces an electric spark to ignite the combustible gas in the cavity. With the flame extension, the pressure and temperature in the cavity increase, the flame is ejected from the first hole and the second hole, forming one or more columnar flames, which enters the combustible gas in the combustion chamber and cylinder, realizing multi-point ignition and high-energy ignition of combustible gas.

2) An internal combustion engine using the flame ejecting spark plug, as shown in FIG. 8. According to the size, number, location and the holes diameter, the flame-ejecting spark plug is designed into various models. The larger the diameter of the nozzle hole, and the higher the injection pressure, the farther the injection distance. Therefore, the diameter of the holes at different positions on the same spark plug can be different. According to the cylinder diameter, displacement and combustion chamber shape of the internal combustion engine, different types of the flame-ejecting spark plug are selected to make the columnar flame of the spark plug disperse well in the combustible gas in the combustion chamber and the cylinder.

6. The Technical Effect of the Invention:

1) The spark generated by the electrode of the spark plug ignites the combustible gas in the semi closed cavity, and the heat released after the combustion of the combustible gas in the cavity is used as the fire source to ignite the combustible gas in the combustion chamber and the cylinder outside the flame-ejecting spark plug.

2) The flame-ejecting spark plug sprays one or more columnar flames into the combustion chamber and cylinder to ignite the combustible gas. This kind of "entry" is better with the effect of "penetration", that is to say, the flame emitted by the spark plug is better with the effect of being able to reach the top end face of the piston, before the combustion of the combustible gas in the combustion chamber and cylinder is completed. The tunnel formed by the columnar flame can make the combustible gas around the tunnel burn out at almost the same time with certain dispersion.

3) The flame ejected from the flame-ejecting spark plug will disturb the combustible gas outside the spark plug, so that the combustion will take a certain time, rather than an instant deflagration. The pressure rise rate in the cylinder is low, which is better to be slightly lower than the pressure rise rate of a diesel engine compression ignition.

4) The compression ratio of the cylinder can be increased, from 10:1 to 21:1 is the appropriate compression ratio range.

5) Due to the increase of ignition intensity, the air-fuel ratio of an internal combustion engine can be increased to achieve lean combustion.

6) Stratified combustion can be realized.

7) The conversion efficiency of engine thermal power is increased by 10-30%.

7. Technical Principle Analysis:

1) When a columnar flame penetrates the mixture of fuel and air in the combustion chamber and the cylinder along the central axis of the cylinder, the interface between the flame tunnel and the combustible gas is very large, which is equivalent to that there are infinite ignition sources at the same time. Compared with the traditional spark plug ignition, the combustion speed of the combustible gas of the engine is about 4 times faster. When more than three columnar flames penetrate the mixture of fuel and air in the combustion chamber and cylinder, the combustion speed of the engine is about 10 times faster than that of traditional spark plug ignition.

2) The columnar flame emitted by the flame-ejecting spark plug is actually radial. In the case of multi columnar flame ignition, the combustible gas near the top of the piston will be ignited by a large area of flame (the projection area of the columnar flame onto the top of the piston is large), and the front edge of flame propagation will leave the top of the piston quickly, so as to reduce the probability of detonation, and even if there is deflagration, the area of deflagration is far away from the piston. For the piston connecting rod mechanism, detonation the impact is greatly reduced, and the noise and vibration are reduced.

3) For the gasoline engine with stratified combustion and lean combustion technology, the compression ratio can be properly increased without knock. In the process of combustion and expansion, the heat loss of gas wall is reduced and the thermal efficiency of engine is improved.

4) Due to the fast combustion speed, compared with the traditional gasoline engine, the time for the ignition of the spark plug to be powered on must be postponed, the combustion time of the compression stroke is reduced, and the negative work of the compression stroke is reduced. Not only the heat release center of the combustion is close to the top dead center, but also the combustion completion time is close to the top dead center, so the thermal efficiency of the engine is improved.

8. Technical Progress and Significance of the Application:

1) Overcome the technical bias in the industry. The traditional spark plug and its ignition technology are mature technologies. For many years, the common sense in the industry has believed that the airspace near the spark plug electrode must be kept open (as shown in FIG. 6) or most of it (as shown in FIG. 7), so as to ensure that the fuel-air mixture or other combustible gases in the combustion chamber can evenly and fully spread around the electrode, so as to be ignited by the spark generated by the electrode. The application has broken such technical prejudice, achieved technical effect unexpected to technical personnel in the industry, and has outstanding substantive characteristics and significant progress.

2) Due to the realization of multi-point ignition, the combustion speed of the internal combustion engine is accelerated, and the possibility of knock is reduced. The gasoline grade (octane index) applicable to the internal combustion engine of the application can be appropriately reduced. For example, if the octane number is less than or equal to 89, the fuel cost will be reduced. For example, an automobile engine with a compression ratio of 10:1 can use 70# gasoline (with an octane number of 70), or 65# gasoline (with an octane number of 65), which is close to the octane range of naphtha, or directly using naphtha as gasoline fuel, the fuel cost is very low.

When the compression ratio is increased to 15:1, gasoline with octane number less than or equal to 89 (research octane number, RON), such as 88# gasoline, will not produce knock. For Atkinson cycle engine, the virtual compression ratio can easily reach 18:1, and the actual compression ratio can reach 12:1-15:1, using 70# gasoline will not produce knock.

Of course, if the octane number of gasoline is higher than 89, the probability of engine knock is lower, and the higher the octane number of gasoline, the better the engine performance. However, the disadvantage is that the higher the octane numbers of gasoline, the higher the cost.

The flame-ejecting spark plug is suitable for homogeneous charge fuel-air mixture ignition, partial premixed diffusion fuel-air mixture ignition, and diffusion fuel-air mixture ignition (stratified combustion).

The flame-ejecting spark plug is suitable as a device for controlling the ignition timing of HCCI.

The flame-ejecting spark plug is suitable for the ignition device of the gasoline direct injection engine with high compression ratio.

Several Notes:

End face of the flame-ejecting spark plug: the top end face of the flame-ejecting spark plug extending into the combustion chamber.

The equivalence coefficient $\lambda$, of air-fuel ratio is a common sense in the industry.

The fuels to which the application applies include but are not limited to gasoline, kerosene, natural gas (biogas), liquefied petroleum gas, other gaseous hydrocarbons, and other biomass fuels.

Electrode material and shape have a great influence on the effect of sparks between electrodes and the life of electrodes. The processing method of electrode, the shape, structure and material selection method of electrode are the prior art.

The pulse discharge between electrodes forms a spark to ignite the mixture of fuel and air. This pulse discharge includes but is not limited to ionization, plasma, laser ignition and other technologies, which are prior technologies. The high-voltage power supply, switch circuit and control system needed for generating high-voltage arc or plasma spark, as well as the selection and processing method of insulating materials, shell materials and other conductive materials for the flame-ejecting spark plug are prior art.

The technology and control method of stratified combustion and lean combustion are the prior art.

The exhaust gas recycling technology of internal combustion engine is a prior art.

BRIEF DESCRIPTION OF THE DRAWINGS

The invention will be described in more detail below based on embodiments and with reference to the accompanying drawings, among them:

FIGS. 4A-4B are the partial structure diagrams of the flame-ejecting spark plug, including: 15 thread, 16 conducting rod, 17 side spraying hole, 18 end spraying hole, 19 spraying angle, 20 insulator, 21 semi closed cavity, 22 shell, electrode (cathode), 23 center electrode, 25 conductive glass, 26 annular spraying hole. FIG. 4B is a schematic view of the end face structure of FIG. 4A.

FIGS. 5A-5C is the schematic diagram of the shape of the spray hole of the flame-ejecting spark plug, in which FIG. 5A is the leaf shape, FIG. 5B is the semicircle ring shape and FIG. 5C is the rectangle shape.

FIG. 6 is a partial drawing of the conventional spark plug in the prior art, showing that the electrode is in an open state.

FIG. 7 is a partial drawing of the conventional spark plug in the prior art, showing that the electrode is in a half open state. This structure of spark plug, the electrode discharge produces sparks to ignite the combustible gas in the combustion chamber, and the flame spreads around the electrode. As compared with FIG. 6, the combustion of combustible gas inside the cathode (negative electrode) will form a pressure greater than that outside, which is conducive to promoting the expansion of the flame surface. FIGS. 4A-4B is different from FIG. 7 in that there is not only a quantitative change in the coverage area, but also a qualitative change in technical ideas, technical measures and technical effects, which is a change from quantitative change to qualitative change. Therefore, the technical solution of FIGS. 4A-4B is creative.

FIG. 8 is a schematic diagram of an internal combustion engine using a flame-ejecting spark plug of the present application, in which: 10 engine, 12 crankshaft, 14 piston, 15 cylinder, 16 combustion chamber, 18 exhaust valve, 20 intake valve, 22 flame-ejecting spark plug, 24 columnar flames.

In the drawings, the same parts use the same reference numerals. The figures are not to the actual scale.

DETAILED DESCRIPTION

Figure 1:
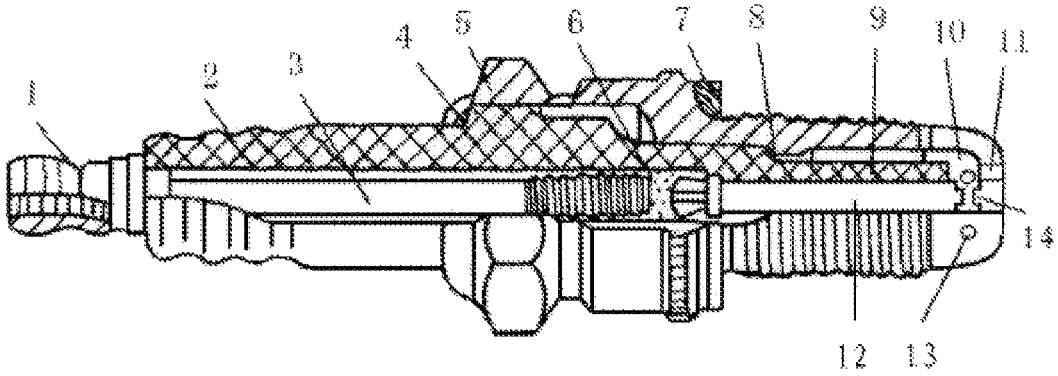
FIG. 1 is an example of the structure of a flame-ejecting spark plug, in which: 1 wiring nut, 2 insulator, 3 metal rod, 4 inner washer, 5 shell, 6 conductor glass, 7 sealing washer, 8 inner washer, 9 insulator skirt, 10 semi closed cavity, 11 end face spray hole, 12 center electrode (anode), 13 side spray hole, 14 cathode electrode. The combustible gas in the combustion chamber enters the semi closed cavity 10 through the end face spray hole 11 and the side spray hole 13. The gap between the center electrode 12 and the cathode electrode 14 is ionized and discharged under the action of high voltage, or plasma discharge is formed under the action of sub-high frequency and high voltage, generating electric spark to ignite the combustible gas in the semi closed cavity 10. The combustible gas burn and forms high temperature and high pressure fire (flame) in the semi closed cavity 10. The compressed flame is ejected from the end face spray hole 11 to form a columnar flame. The columnar flame penetrates the combustible gas in the combustion chamber and cylinder and reaches the end face of the piston top to ignite the combustible gas in multiple points. Inside the semi-closed cavity, a protruding structure may be provided on the cathode electrode 14 for adjusting the distance from the middle position of the gap between the cathode and the anode electrode to the end face of the flame-ejecting spark plug. The side jet hole 13 also ejects a columnar flame to ignite the combustible gas in the combustion chamber.

FIG. 1 is an example of the structure of a flame-ejecting spark plug, in which: 1 wiring nut, 2 insulator, 3 metal rod, 4 inner washer, 5 shell, 6 conductor glass, 7 sealing washer, 8 inner washer, 9 insulator skirt, 10 semi closed cavity, 11 end face spray hole, 12 center electrode (anode), 13 side spray hole, 14 cathode electrode. The combustible gas in the combustion chamber enters the semi closed cavity 10 through the end face jet hole 11 and the side face jet hole 13. The gap between the center electrode 12 and the cathode electrode 14 is ionized and discharged under the action of high voltage, or plasma discharge is formed under the action of sub high frequency and high voltage, generating spark to ignite the combustible gas in the semi closed cavity, and the combustible gas burn and forms high temperature and high pressure fire in the semi closed cavity. The flame is ejected from the end hole to form a columnar flame. The columnar flame penetrates the combustible gas in the combustion chamber and the cylinder and reaches the end face of the piston top to ignite the combustible gas at multiple points. The side jet hole 13 also ejects a columnar flame to ignite the combustible gas in the combustion chamber.

The better technical effect is that after the combustion of the fuel and air in the cavity, the flame is ejected from the end hole, which can penetrate the mixture of fuel and air in the combustion chamber and cylinder to reach the top of the piston, and the higher the dispersion of the flame column in the combustible gas, the better the ignition effect is, and the larger the specific surface of the flame column is, the better the ignition effect is. The columnar flame beams are dispersed at a certain angle, so that the partitioned volume of the fuel and air mixture (combustible gas) around the end of the flame beam is approximately the same, so that the combustion end time of the combustible gas around the flame beam is approximately the same. The end and side holes have a certain jet angle along the radial direction. The better design is that these spray holes have a certain angle along the circumferential direction at the same time, so that the path of the flame beam passing through the combustible gas is longer, and the combustible gas is stirred to form a rotating air flow.

FIG. 8 is a schematic diagram of an internal combustion engine using a flame-ejecting spark plug of the present application, wherein the columnar flame 24 ejected by the flame-ejecting spark plug 22 disperses into the combustible gas in the combustion chamber 16 and the cylinder 15, and penetrates the combustible gas to the end surface at the top of the piston 14.

The Preferred Technical Solution Includes:

1) Place the side spray hole near the end face of the cavity. The position of the side jet hole near the root of the semi closed cavity (far away from the end face) is conducive to the entry of combustible gas into the cavity and is not conducive to the increase of the flame jet pressure.

2) There are many choices of jet angle and tilt angle, the number and shape of jet holes, the proportion of the total area of end jet holes to the end area of cavity, and the proportion of the total area of jet holes to the effective volume of cavity. These parameters will affect the combustion speed, temperature and pressure of combustible gas in the cavity, the injection speed and distance after the flame is ejected from the injection hole, and the state of flame dispersion in the combustible gas in the combustion chamber and cylinder. The better effect is that the columnar flame can penetrate the combustible gas, but it will not impact the cylinder and piston, and will not produce large vibration. According to the above effects and purposes, it is the common sense of the technical personnel in the industry to select the above parameters of the spark plug.

3) In view of the increasing trend of combustion speed and combustion temperature, lean combustion can be realized by increasing air-fuel ratio in the engine.

4) Further, in order to reduce the excessive oxygen content in the fuel-air mixture, reusing part of exhaust gas is also an optimized technical scheme.

According to the structure and performance requirements of internal combustion engine, the model and parameters of the flame-ejecting spark plug are selected, which is a common sense in the industry.

In order to increase the injection pressure and ensure that the equivalence coefficient $\lambda$, of the air-fuel ratio in the semi closed cavity of the flame-ejecting spark plug is near 1, the technical scheme of supplying fuel to the flame-ejecting spark plug alone can be adopted. Alternatively, it is also an option to set a cavity in the combustion chamber of the internal combustion engine, configure the fuel injection system for the cavity separately, and then install the traditional spark plug in the cavity. The disadvantage of the above two technical solutions is that the cost of structure complexity increases. The preferred alternative of this application is to design the injection direction of the fuel injection nozzle of the internal combustion engine to be relatively close to the position of the end face of the flame-ejecting spark plug. The internal combustion engine with multiple fuel injection is conducive to the diffusion of fuel into the cavity.

The side holes may not be set to increase the injection pressure and distance. The disadvantage is that it is not conducive to the diffusion of fuel from the combustion chamber into the semi closed cavity.

As the compression stroke piston approaches the TDC (top dead center), the density of combustible gas in the combustion chamber increases, and the energy accumulated by the combustible gas in the cavity of the flame-ejecting spark plug increases gradually, and the intensity (energy) of the flame jet increases when the ignition occurs. The distance of combustible gas to be penetrated by the flame beam sprayed by the flame-ejecting spark plug shall be shortened to facilitate penetration. Therefore, when the ignition start time is close to the TDC, the ignition effect is better.

In addition to the circular shaped hole, the special shaped hole is selected, as shown in FIGS. 5A-5C, it is beneficial to increase the specific surface of the columnar flame and increase the ignition efficiency.

Figure 3A:
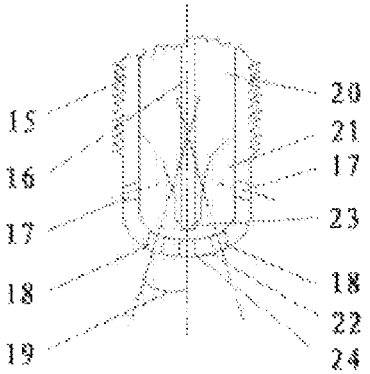
FIG. 3A shows the local structure of the flame-ejecting spark plug, including: 15 thread, 16 conducting rod, 17 side spray hole, 18 end spray hole, 19 spray angle, 20 insulator, 21 semi closed cavity, 22 shell, electrode (cathode), 23 center electrode, 24 center spray hole.
Figure 3B:
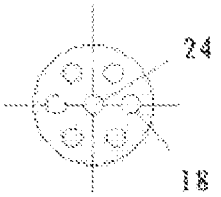
FIG. 3B is a schematic end face view of FIG. 3A.

Embodiment (Example) 1: the parameters of a typical spark plug are shown in FIG. 3, and the effective volume in the semi closed cavity 21 shown in FIGS. 3A and 3B is 0.6 cm3. The number of end face spray holes is 7 (including 1 center spray hole 24), and the holes shape is circle. The injection angle of the central orifice 24 is 0. The radial spray angle of the other six end face spray holes 18 is 30 degrees, and the circumferential inclined angle is 20 degrees. The total area of the end face holes 18 (including the center orifice 24) is 25% of the circular section area of the cavity volume (corresponding to the end face). The number of side spray holes 17 is 2, symmetrical distribution, the hole shape is circular, the hole diameter of side spray holes is ⅔ of the end spray holes, the radial spray angle of side spray holes 17 is 45 degrees, and the circumferential inclined angle is 15 degrees.

Figure 3C:
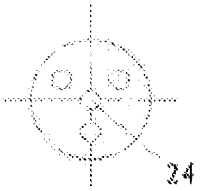
FIG. 3C is a schematic diagram of the end face view corresponding to another arrangement scheme of the end face spray hole in FIG. 3A.

When FIG. 3C is used instead of FIG. 3B as the layout of the end orifice, the number of the end holes 18 (including the center orifice 24) is 4, and the total area of the end holes 18 (including the center hole 24) is 20% of the volume circular section area of the cavity. Compared with FIG. 3B, the total area of the end face holes 18 (including the center hole 24) and the circular section area of the cavity volume (corresponding to the end face) are reduced, and the injection pressure is increased. At the same time, the number of the end face hole is reduced, and the area of a single hole is increased, so the ejecting distance is increased.

Figure 2A:
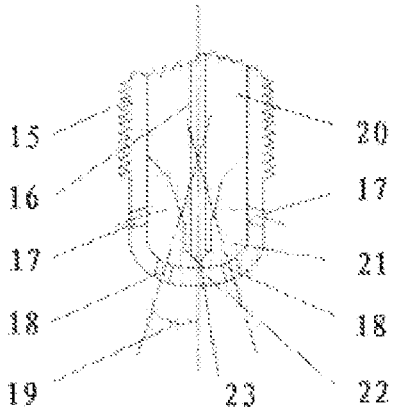
FIG. 2A shows the local structure of the flame-ejecting spark plug, including 15 threads, 16 conducting rods, 17 side spray holes, 18 end spray holes, 19 spray angle, 20 insulator, 21 semi closed cavity, 22 shell, electrode (cathode), 23 center electrode.
Figure 2B:
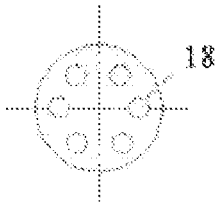
FIG. 2B is a schematic end face view of FIG. 2A. All holes are at the same distance from the middle of the gap between the electrodes of cathode and anode.
Figure 2C:
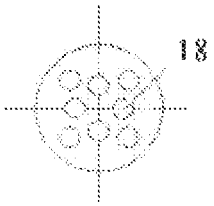
FIG. 2C is a schematic view of the end face corresponding to another arrangement scheme of the end face spray hole in FIG. 2A.

Embodiment 2, the center electrode 23 of FIG. 2A is hidden in the shell 22 of the semi closed cavity 21. Compared with the semi exposed center electrode 23 of FIG. 3A and the exposed center electrode 23 of FIG. 4A, the direct ignition of the electrode spark to the combustible gas in the combustion chamber is avoided. The ignition action is divided into two parts, one is the electrode spark to ignite the combustible gas in the semi closed cavity 21, the other is the semi closed cavity 21 ejecting flames from the holes after the combustion of the combustible gas in the semi closed cavity 21, to ignite the combustible gas in the combustion chamber and cylinder. In this way, the time interval of the combustible gas to be igniting in the combustion chamber and cylinder between the top and bottom of combustion chamber and even the depth of cylinder is shortened. The disadvantage is that the concentration of combustible gas near the electrode is greatly affected by the diffusion time of fuel in the combustion chamber. This kind of spark plug is more suitable to be used as the ignition device of the internal combustion engine with fully premixed fuel, or as the ignition device of the internal combustion engine with multiple fuel injection into the cylinder and relatively high fuel concentration at the end of the spark plug in the combustion chamber.

Embodiment 3, the position of positive and negative electrodes (23 and 22) of the spark plug shown in FIG. 4A is at the edge of the boundary between the semi closed cavity 21 and the combustion chamber (this edge is exactly the gap position between the positive and negative electrodes, and also the position of the annular jet hole 26), which is exposed outside the semi closed cavity 21. The concentration and air-fuel ratio of the combustible gas around the electrode are the same as most areas of the combustion chamber. The reliability of electrode ignition is almost independent of the diffusion effect of combustible gas into semi closed cavity 21. In addition to the ignition requirements of general internal combustion engines, this kind of the flame-ejecting spark plug is more suitable for the ignition device of lean burn engines, such as HCCI.

When spark ignition device is used in the start-up phase of HCCI gasoline engine, it can be ignited directly when the equivalence coefficient $\lambda$, of air-fuel ratio is greater than 1.

Embodiment 4: since the spark plug of the application has high ignition intensity and energy, and belongs to multi-point ignition, the spark plug of the application can be used as a forced ignition device of HCCI gasoline engine. On the basis of various technical measures and technical schemes of existing HCCI gasoline engine, the heat release equivalent and depth of chemical reaction between pre injected fuel and high-temperature exhaust gas and air mixture are reduced. The energy required for compression ignition shall be kept at a safe distance to ensure that the fuel-air mixture will not have early combustion and detonation. Then, when the compression stroke piston reaches or near the top dead center position, the spark plug of the application is used for ignition as the trigger of homogeneous charge compression ignition (HCCI) to realize forced ignition. That is to say, the energy of forced ignition of the flame ejecting spark plug is used to trigger HCCI ignition. In this case, HCCI gasoline engine can operate freely and easily in the working environment of changing speed and load greatly, and it will not lost-fire as ignition later or knock because of early combustion, so it has the equipment conditions as a single power unit of automobile.

Embodiment 5, FIGS. 5A-5C shows the sections of several special-shaped spray holes, in which FIG. 5A is a leaf shape, FIG. 5B is a half circular ring shape and FIG. 5C is a rectangle shape. In addition to the section of the special-shaped orifice shown in FIGS. 5A-5C, the section of other special-shaped orifice includes but is not limited to the torus shape (a ring shape with one or more gaps), triangle shape, triangle with three sides recessed, trilobal, trilobal with three rectangles connected, and the combination of the above shapes.

Embodiment 6, in order to increase the ignition energy of the spark plug and the effective volume of the semi closed cavity, the size of the shell shoulder on the left side of the sealing washer 7 in FIG. 1 is enlarged, and the size of the shell on the right side of the shoulder and the washer 7 are enlarged at the same time. If necessary, seal washer 7 and the shoulder on the left side can be the area with the largest spark plug diameter. For example, increase the diameter of thread 15 in FIGS. 2A, 3A and 4A from 14 mm to 20 mm (include 14-20 mm). Or extend the length of the semi closed cavity in the axial direction of the flame-ejecting spark plug.

Embodiment 7, the spark plug is applied to the turbine engine as the ignition device. The air flow in the semi closed cavity is less affected by the high-speed air flow disturbance of the external combustion chamber, and the ignition stability and reliability are high.

Embodiment 8, the principle of the spark plug of this application is used as the ignition rod in industrial furnace and other devices.

The application scope of the spark plug includes but is not limited to the above embodiments. The structure, appearance and shape of the spark plug include but are not limited to those shown in FIG. 1, FIGS. 2A-2C, FIGS. 3A-3C, FIGS. 4A-4B, and FIGS. 5A-5C.

Figure 9:
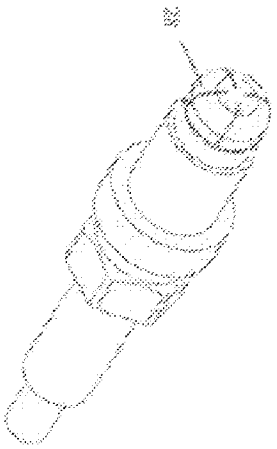
FIG. 9 shows the structure of a kind of flame-ejecting spark plug, in which: 28 is gaps to replace the first holes and second holes, and 4 gaps are not connected at the end face of the spark plug. The flame in the cavity enters the combustion chamber and the cylinder through four gaps, and the combustible gas in the combustion chamber and the cylinder is divided and ignited.

Embodiment 9, as shown in FIG. 9, is a kind of spark plug, wherein: 28 is the gap replacing the first hole and the second hole, 4 gaps evenly divide the end face and the side face of the semi closed cavity of the spark plug, and are not connected at the end face of the spark plug. The flame ejecting from the semi closed cavity enters the combustion chamber and the cylinder through the four gaps, and the combustible gas in the combustion chamber and the cylinder is divided and ignited. Four gaps can be replaced by three equally divided or more than five.

I claim:

1. A flame-ejecting spark plug, which is characterized in that, on the basis of a conventional spark plug, a space near electrodes is closed to form a cavity, one or more first holes are opened on the end face of the cavity, one or more second holes are opened on the side face of the cavity, a mixture gas of air and fuel enter the cavity through the first hole and the second hole, and sparks are generated between the electrodes to ignite the combustible gas in the cavity, as the flame in the cavity extends and the temperature and pressure rise, the flame is ejected from the first hole and the second hole to form a columnar flame, and the flame enters the combustible gas in a combustion chamber and a cylinder to realize stereoscopic ignition and high-energy ignition of the combustible gas in the combustion chamber and the cylinder;

an numerical value of a distance from the middle position between a cathode and an anode of the electrodes to the edge of the nearest first hole is 0.1-0.9% of the volume of the cavity, at the same time, the volume of the cavity inside the spark plug is divided into two parts along the section of the central axis of the spark plug in the middle position between the cathode and the anode of the electrodes, the volume close to the first hole accounts for one-fifth to one-half of the total volume;

the combustion pressure in the spark plug cavity can make the speed of the columnar flame ejected from the first hole reach 150 m/s or more, and the preferred speed is 225-375 m/s; the injection distance of the columnar flame ejected from the first hole exceeds the distance from the top of the combustion chamber to the top of the piston when the piston is in the middle position between the bottom dead center and the top dead center.

2. The flame-ejecting spark plug of claim 1, wherein the first hole on the end face of the cavity and the second hole on the side face have a jet angle in the radial direction of the cavity, or have a tilt angle in the circumferential direction while having the jet angle;

the shape of jet hole is one of circle, circular ring, leaf, semicircle, rectangle, triangle, trilobal, or a combination of the above shapes;

the volume close to the first hole accounts between one-quarter and one-third of the total volume, so that the columnar flame of the first hole has a fast spraying speed and a long spraying distance.

3. The flame-ejecting spark plug of claim 1, wherein the spark plug is replaced by only the first hole, but not the second hole.

4. The flame-ejecting spark plug of claim 2, wherein the cathode and anode of the electrodes are arranged in the direction perpendicular to the central axis of the spark plug, that is, the cathodes of the electrodes are distributed on both sides or four sides of the anode.

5. An internal combustion engine, which is characterized in that a kind of the flame-ejecting spark plug as described in claim 1 is selected to use as an ignition device, the fuel and air of the internal combustion engine are used as the main energy source for ignition.

6. The internal combustion engine of claim 5, wherein the engine simultaneously uses two or more flame-ejecting spark plugs for ignition, or uses a combination of the flame-ejecting spark plug and a traditional spark plug as the ignition device.

7. The internal combustion engine of claim 5, wherein a stratified combustion technology and control scheme are adopted, or a lean combustion technology and control scheme are adopted, or the stratified combustion and the lean combustion technology and control scheme are adopted at the same time.

8. The internal combustion engine of claim 5, wherein the compression ratio of the cylinder is 10:1 to 21:1; or it is provided with a turbocharging device at the same time; or it is provided with a turbocharging device and a supercharging device at the same time.

9. A flame-ejecting spark plug of claim 1 is used as the ignition device of a turbine engine or a gas turbine.

10. An internal combustion engine vehicle or hybrid electric vehicle, which is characterized in that the engine as described in claim 5 is used as a power device.

11. The internal combustion engine, which is characterized in that a kind of the flame-ejecting spark plug as described in claim 2 is selected to use as an ignition device, the fuel and air of the internal combustion engine are used as the main energy source for ignition.

12. The internal combustion engine, which is characterized in that a kind of the flame-ejecting spark plug as described in claim 3 is selected to use as an ignition device, the fuel and air of the internal combustion engine are used as the main energy source for ignition.

13. The internal combustion engine, which is characterized in that a kind of the flame-ejecting spark plug as described in claim 4 is selected to use as an ignition device, the fuel and air of the internal combustion engine are used as the main energy source for ignition.

14. The internal combustion engine vehicle or hybrid electric vehicle, which is characterized in that the engine as described in claim 6 is used as a power device.

15. The internal combustion engine vehicle or hybrid electric vehicle, which is characterized in that the engine as described in claim 7 is used as a power device.

16. The internal combustion engine vehicle or hybrid electric vehicle, which is characterized in that the engine as described in claim 8 is used as a power device.

17. The internal combustion engine vehicle or hybrid electric vehicle, which is characterized in that the engine as described in claim 9 is used as a power device.

* * * * *